US005221069A

United States Patent [19]

Struthers et al.

[11] Patent Number: 5,221,069

[45] Date of Patent: Jun. 22, 1993

[54] TELESCOPING SUPPORT BRACKET

[75] Inventors: Scott Struthers; William J. Kindel, both of San Clemente; Ronald D. Maurer, El Cajon; Geoffrey L. Spencer, Laguna Niguel, all of Calif.

[73] Assignee: Dana Innovations, San Clemente, Calif.

[21] Appl. No.: 881,690

[22] Filed: May 12, 1992

[51] Int. Cl.[5] ..... A47F 5/08

[52] U.S. Cl. ..... 248/231.9; 248/314; 248/343

[58] Field of Search ..... 248/231.9, 343, 314, 248/27.1, 906; 181/150; 381/188

[56] References Cited

U.S. PATENT DOCUMENTS

| | | | |
|---|---|---|---|
| 3,912,865 | 10/1975 | Seebinger | 248/343 X |
| 4,778,134 | 10/1988 | Struthers et al. | 248/343 X |
| 4,815,558 | 3/1989 | Krainhofer | 181/150 X |
| 4,853,966 | 8/1989 | Skrzycki | 181/150 X |
| 5,082,083 | 1/1992 | Draffen | 181/150 |
| 5,143,339 | 9/1992 | Ashcraft et al. | 248/343 |

*Primary Examiner*—Ramon O. Ramirez
*Attorney, Agent, or Firm*—Stetina and Brunda

[57] ABSTRACT

A telescoping support bracket for providing convenient installation of wall mounted speakers and the like comprises a body attachable to an architectural structure such as a wall or ceiling and a telescoping member slidably movable relative to the body to which a bezel may be attached. The bezel is configured to receive and attach the desired component. Movement of the telescoping member relative to the body provides depth adjustment to compensate for varying wall covering thickness such that a desired surface of the component may be mounted flush with the outside surface of the architectural structure. Thus, a speaker, for example, may be quickly mounted with the grill flush to the outside surface of a wall. The telescoping mount bracket of the present invention thereby eliminates the need to perform a custom installation wherein custom brackets and/or other fixtures must typically be fabricated.

20 Claims, 2 Drawing Sheets

TELESCOPING SUPPORT BRACKET

FIELD OF THE INVENTION

The present invention relates generally to support brackets. It relates more particularly to a telescoping support bracket for mounting speakers and the like into the walls or ceilings of frame-and-wallboard building structures.

BACKGROUND OF THE INVENTION

The demand for high quality speakers has increased dramatically over the last twenty years. As a consequence, a large selection of high quality speakers is available on the market. Because speakers are somewhat bulky and cumbersome there have been a number of efforts to mount high quality speakers in the ceiling and in the wall. However, high quality speakers suitable for mounting in the ceiling or wall are frequently expensive, typically requiring custom-made brackets. Moreover, the wall on which the speakers are to be mounted must be of sufficient depth to accommodate the speaker cone and magnet.

The custom fabrication of a mount bracket and/or the modification of the wall into which speakers are to be installed involves a substantial number of steps which increase the time required to perform the installation and consequently likewise increase the associated cost.

U.S. Pat. No. 4,778,134 issued to STRUTHERS, ET AL. discloses a bracket for mounting speakers in the ceiling or wall. The brackets disclosed in that patent use two thin support wings to attach the bracket housing to the framing members. Though suitable for many applications those brackets do not provide for any positional adjustment of the housing within the wall. Consequently the depth of the speaker is set once the support wings are secured to the framing members.

Additionally, it is often desirable to mount various other components such as control boxes, lights, and the like within an architectural structure such as a ceiling or wall. The mounting of such other components within an architectural structure has posed many of the same problems as the mounting of speakers as described above. Generally, it is desirable to mount the component such that a particular surface of the component is mounted flush to the surface of the wall or ceiling. This necessitates that the bracket be sized and located properly within the wall to flush mount the component along the outer surface of the architectural structure. Thus, the mounting of such components within an architectural structure is typically time consuming and expensive.

Although the prior art has recognized to a limited extent the problem of providing a means to mount speakers, control boxes, and the like within a ceiling or wall, the proposed solutions have to date been ineffective in providing a satisfactory remedy. Thus, there exists a substantial need in the art for an improved adjustable mounting bracket.

SUMMARY OF THE INVENTION

The present invention specifically addresses and alleviates the above-mentioned deficiencies associated in the prior art. More particularly, the present invention comprises a telescoping speaker support bracket for providing convenient installation of wall mounted speakers and the like. The telescoping mount bracket generally comprises a body disposable within an architectural structure such as a wall or ceiling, and a telescoping member movable relative to the body. A bezel, to which a speaker or like component may be attached, is attached to the telescoping member. The telescoping tubular member may be locked at various positions relative to the body via detent means whereby various lengths of the telescoping tube may extend from the body to compensate for various exterior member or wall covering thicknesses. The detent means may comprise at least one post formed upon the body and a plurality of slots formed upon the telescoping member for engaging the post. Movement of the mount relative to the body provides depth adjustment such that the body may be attached to the interior of an architectural structure, i.e., framing members or studs, and the component may then be attached to the bezel such that a desired surface of the component is substantially flush with the exterior member or outside surface of the architectural structure. Thus, a speaker, for example, may be quickly mounted with the grill substantially flush to the outside surface of a wall. The telescoping mount bracket of the present invention thereby eliminates the need to perform a custom installation wherein custom brackets and/or other fixtures must be fabricated.

These, as well as other advantages of the present invention, will be more apparent from the following description and drawings. It is understood that changes in the specific structure shown and described may be made within the scope of the claims without departing from the spirit of the invention.

DETAILED DESCRIPTION OF THE PREFERRED EMBODIMENT

Figure 1:
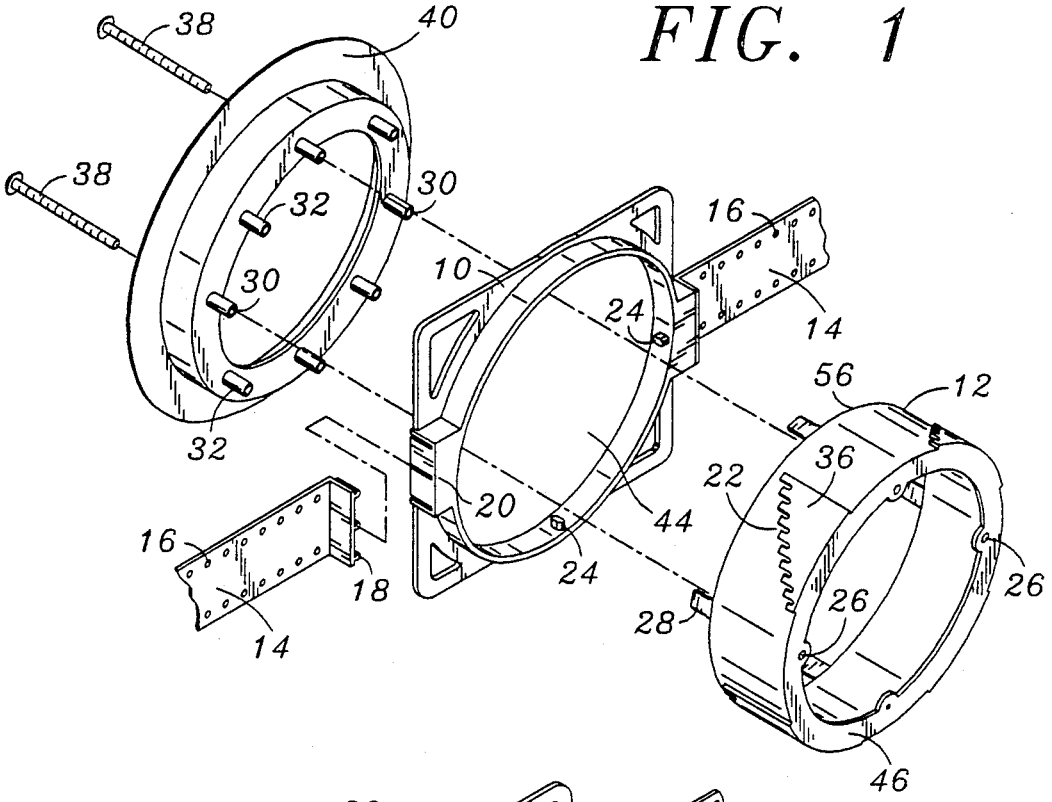
FIG. 1 is an exploded rear perspective view of the telescoping mount bracket of the present invention.
Figure 2:
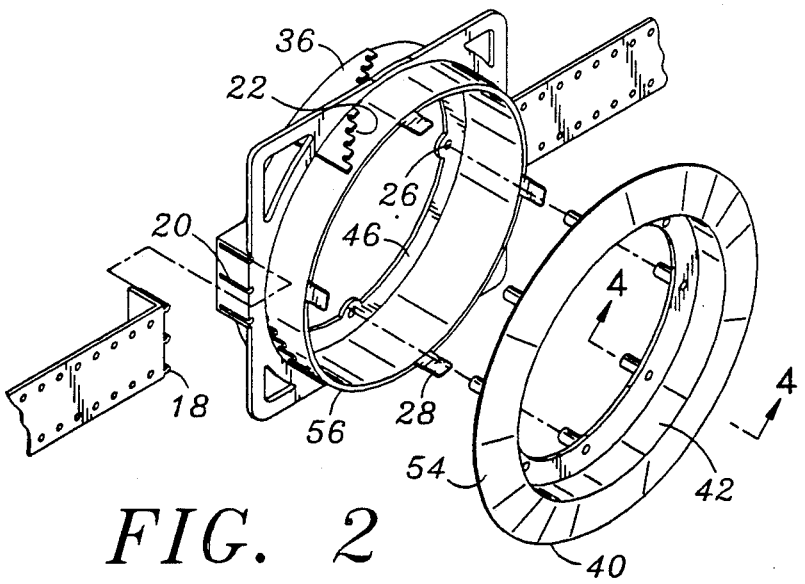
FIG. 2 is a front perspective view of the telescoping mount bracket of the present invention having the telescoping member disposed within the body.

The detailed description set forth below in connection with the appended drawings is intended merely as a description of the presently preferred embodiment of the invention, and is not intended to represent the only form in which the present invention may be constructed or utilized. The description sets forth the functions and sequence of steps for construction and implementation of the invention in connection with the illustrated embodiment. It is to be understood, however, that the same or equivalent functions and sequences may be accomplished by different embodiments that are also intended to be encompassed within the spirit and scope of the invention.

The telescoping mount bracket of the present invention is illustrated in FIGS. 1–7 which depict a presently preferred embodiment of the invention. Referring now to FIGS. 1-5, the telescoping mount bracket is comprised generally of a body 10 and a telescoping tubular member 12 slidably received within a central opening 44 in the body 10. Flanges or wings 14, each having an array of apertures 16 formed therein are attachable to the body 10. Attachment of the wings 14 to the body 10 is preferably via sliding engagement of male dovetail members 18 formed upon the wings 14 within female dovetail members 20 formed upon the body 10. Those skilled in the art will recognize that various configurations for slidable engagement of the wings 14 and the body 10 are likewise suitable.

A plurality of slots 22 configured in a stair-step fashion, are positioned about the outer surface of the telescoping tubular member 12 and engage corresponding complimentary projections 24 formed within the central opening 44 of the body 10 to define detents for locking the telescoping tubular member 12 in a desired position relative to the body 10. Those skilled in the art will recognize that various other detent arrangements are likewise suitable. Preferably either two or four sets of slots 22 and posts 24 are utilized. The slots 22 are formed upon elevations 36 which protrude from the telescoping tubular member 12.

Figure 3:
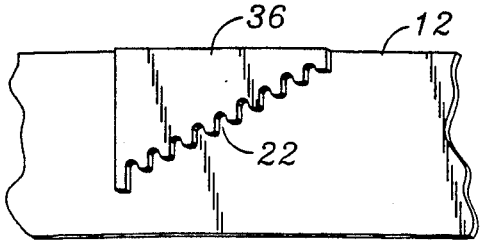
FIG. 3 is an enlarged perspective side view of the telescoping member showing the slot detents formed thereupon.
Figure 4:
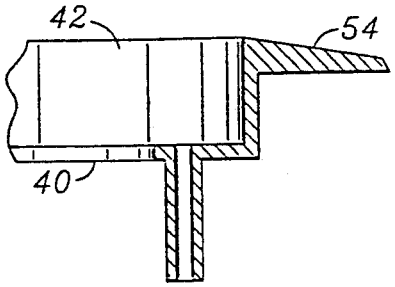
FIG. 4 is a cross-sectional side view of the bezel of FIG. 2 taken along line 4.

The slots 22 of the telescoping tubular member 12 (as best shown in FIG. 3) lock the telescoping tubular member 12 into position relative to the body 10 once the clamping bolts 38 are tightened as discussed below. The slots 22 are formed of sufficient depth that it is thus necessary to slightly retract the telescoping tubular member 12 from the body 10 before effecting rotation thereof for length adjustment. The slots 22 and posts 24 thus prevent inadvertent rotation of the telescoping tubular member 12 and consequent inadvertent changes in the length of the telescoping mount bracket. Thus, the use of slots 22 and post 24 as a detent means provides a positive locking arrangement.

Figure 5:
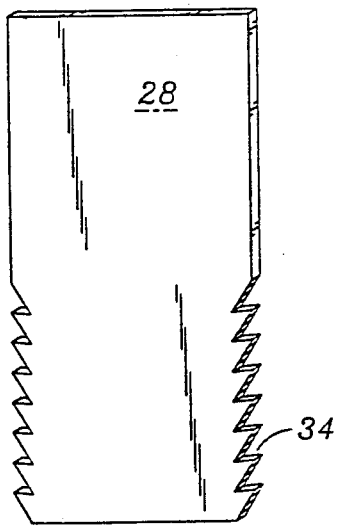
FIG. 5 is a perspective view of a tab having barbed edges.

Bendable tabs 28, best shown in FIG. 5, are formed proximate the distal outer periphery of the telescoping tubular member 12. The tabs 28 originally extend in a direction parallel to the axis of the telescoping tubular member 12. The tabs 28 may be bent 90 degrees to a position where they extend radially outward. The bendable tabs 28 may be formed of a metal such that they are bendable yet will retain their bent configuration during use. The tabs 28 are thus suitable for temporarily securing the body 10 and telescoping tubular member 12 in position during installation as described in detail below. The tabs 28 may optionally be provided separate from the body 10 and installed into preformed slots within the body 10 as desired. Barbs 34 formed along the lower edges of the tab 28 may be utilized to prevent the tabs 28 from being inadvertently pulled from the body 10.

A speaker support or bezel 40 is attachable to the tube 12 via fasteners or clamping bolts 38. Apertures 30 formed in the bezel 40 receive clamping bolts 38. Apertures 32 formed in the bezel 40 facilitate the mounting of a speaker or other component thereto. Threaded apertures 26 formed upon a flange 46 extending inwardly from the rearmost periphery of the telescoping tubular member 12 provide for the attachment of the bezel 40 to the telescoping tubular member 12. The bezel 40 has a tapered portion 54 (best shown in FIG. 4) and a recess 42 into which a grill (not shown) may be disposed as is common in contemporary wall mount speaker assemblies.

Figure 6:
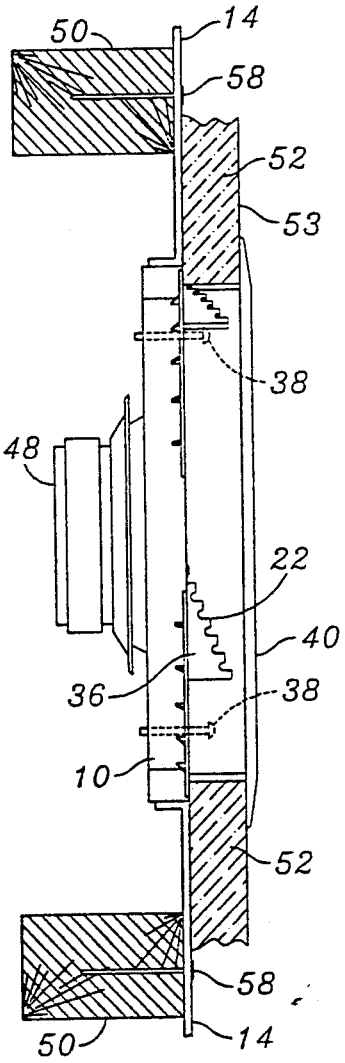
FIG. 6 is a cross-sectional top view of the telescoping mount bracket of the present invention having a speaker installed therein and being installed within a wall.
Figure 7:
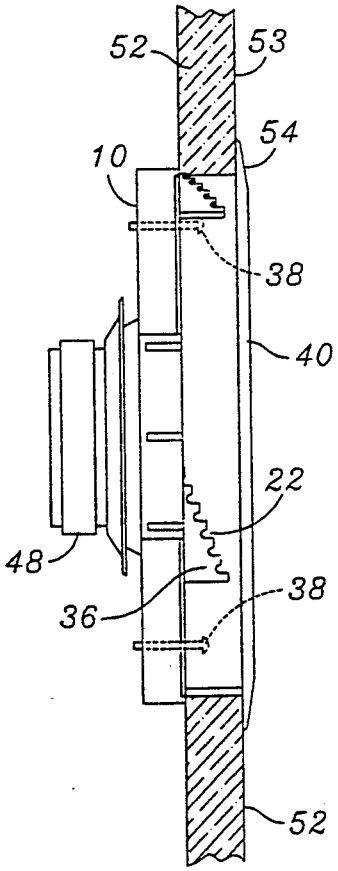
FIG. 7 is a cross-sectional side view of the installed telescoping mount bracket of FIG. 6.

Referring now to FIGS. 6 and 7, use of the telescoping mount bracket of the present invention during new construction, i.e., prior to the installation of drywall is illustrated. The wings 14 are attached to the body 10 and the telescoping tubular member 12 is inserted therein. The body 10 is then positioned at a desired location among the studs 50 of an architectural structure such as a wall or ceiling such that each of the wings 14 extend across a stud 50. Fasteners, such as screws or nails 58 are then applied through the apertures 16 and into the studs 50 to secure the wings 14 thereto. The tube 12 may be slidably adjusted in or out relative to the wings 14 to provide a degree of depth adjustment. The tabs 28 are generally not required during new construction installation since the wings 14 secure the body 10 in place prior to tightening of the clamping bolts 38. The telescoping tubular member 12 is adjusted to extend from the body 10 by a length which will position its forward periphery 56 (FIG. 1) flush with the outer surface 53 of the latter installed wall covering 52.

Plasterboard, or other wall covering 52 forms an exterior member and is then applied over the studs 50 and telescoping mount bracket. An aperture is formed by the installer in the plasterboard or other wall covering 52 to receive the telescoping tubular member 12 of the telescoping mount bracket. This aperture is preferably formed prior to applying the wall covering 52 to the studs 50. The extension of the telescoping tubular member 12 from the body 10 may be readjusted as necessary after the wall covering 52 is applied such that the forward periphery 56 is flush with the outer surface 53 of the wall covering 52.

A bezel 40 is attached to the tube 12 via clamping bolts 38 of sufficient length to span the distance between the bezel apertures 30 and the threaded apertures 26. The bezel 40 is adapted to attach a desired component such as a speaker thereto.

As shown in FIGS. 6 and 7, tightening the clamping bolts 38 sandwiches or captures the exterior member or drywall covering 52 between the bezel 40 and the body 10 such that a clamping action is provided to secure the telescoping mount bracket of the present invention in position. Thus, the bezel 40 is mounted flush to the exterior surface 53 of the architectural structure, thereby providing a substantially flush mount for the component.

To install the telescoping mount bracket of the present invention in a previously constructed architectural structure such as a wall or ceiling, a generally round aperture of sufficient size to receive the body 10 with the telescoping tubular member 12 received therein is first made within the exterior member or drywall of the architectural structure. The opening is sized to receive the body 10 and telescoping tubular member 12 when the generally planar rectangular body 10 is oriented substantially perpendicularly to the wall covering and not to pass the body 10 and telescoping tubular member 12 therethrough when the body 10 is oriented substantially parallel thereto, such that the body 10 may be inserted through the opening and rotated 90 degrees to prevent its removal. The rotated position is the substantially parallel position illustrated in FIGS. 6 and 7.

The body 10 and telescoping tubular member 12 are passed through the aperture and the body 10 is held flush to the inner surface of the wall covering. The telescoping tubular member 12 is then adjusted such that its outermost surface or forward periphery 56 is flush with the outer surface 53 of the exterior member or wall covering 52. The tabs 28 are then bent outward to prevent the body 10 and telescoping tubular member 12 from falling inward.

The wings 14 will generally not be utilized in the installation of the telescoping mount bracket of the present invention into a prior constructed architectural structure since this would involve removal and replacement of a large portion of drywall. Rather, the body 10 and telescoping tubular member 12 are initially secured in place via tabs 28. Next, the clamping bolts 38 are inserted through the clamping bolt apertures 30 in the bezel 40 and the bezel 40 is then attached to the tube 12 by further inserting the clamping bolts 38 through the threaded clamping bolt apertures 26 of the telescoping tubular member 12. Tightening the clamping bolts 38 thus captures a portion of the drywall or wall covering 52 as described previously and illustrated in FIGS. 6 and 7.

After installing the telescoping mount bracket of the present invention into an architectural structure, a component such as a stereo speaker 48 may be attached thereto. Those skilled in the art will recognize that various components, e.g., lights, controls, or works of art, may likewise be installed within an architectural structure utilizing the telescoping mount bracket of the present invention. The component is generally secured to the bezel 40 by inserting fasteners such as screws through the component and into the threaded mount apertures 32.

Alternatively, a screw thread arrangement may be utilized to affect telescoping as opposed to the post and stair step detent arrangement discussed above. That is, complimentary screw threads could be formed upon the tubular member 12 and the body 10 such that rotation of the tubular member 12 relative to the body 10 results in extension of the tubular member 12 therefrom. Thus, as the tubular member 12 is rotated it screws itself into or out of the body 10 in the same manner that a bolt screws into or out of a threaded hole.

It is understood that the exemplary telescoping mount bracket described herein and shown in the drawings represents only a presently preferred embodiment of the invention. Indeed, various modifications and additions may be made to such embodiment without departing from the spirit and scope of the invention. For example, although the bracket shown and described is configured specifically for the mounting of substantially round components, those skilled in the art will recognize that components of various geometric configurations, i.e., rectangular or square, may likewise be mounted. Also, although a stair step configuration of slotted detents is described and illustrated, those skilled in the art will recognize that various other detent mechanisms may be utilized to provide a sliding or telescoping adjustment whereby a substantially flush mounting of the desired component may be obtained. Thus, these and other modifications and additions may be obvious to those skilled in the art and may be implemented to adapt the present invention for use in a variety of different applications.

What is claimed is:

1. A telescoping speaker support bracket for attaching a speaker to an architectural structure, the architectural structure having an interior frame and an exterior member, the telescoping mount bracket comprising:

(a) a body attachable to the interior frame;

(b) a telescoping member adjustably extendable from said body substantially to the exterior member; and (c) a speaker support attachable to said telescoping member configured to support the speaker, said speaker support comprising a bezel;

(d) wherein extension of said telescoping member from said body allows the speaker to be mounted substantially flush with the exterior member despite variations in the size of the interior frame and the exterior surface member.

2. A telescoping speaker support bracket for attaching a speaker to an architectural structure, the architectural structure having an interior frame, an exterior surface member, and an opening formed in the exterior surface member, the telescoping mount bracket comprising:

(a) a generally planar rectangular body configured to pass through the opening in the exterior member and into the architectural structure when oriented substantially perpendicularly thereto and configured not to pass through the opening when oriented substantially parallel thereto such that said body may be inserted through the opening and then rotated 90 degrees to prevent its removal, said body having a generally circular central opening formed therein;

(b) at least one post extending inwardly from the central opening of said body;

(c) a generally tubular telescoping member configured to be slidably received within the central opening of said body;

(d) a plurality of slots arranged in a stair step configuration formed upon said telescoping tubular member, said slots cooperating with said post to lock said telescoping tubular member in position relative to said body; and (e) a bezel attachable to said telescoping tubular member, said bezel configured to receive and attach the speaker, said bezel and said body configured to capture a portion of the wall covering therebetween;

(f) wherein said generally tubular telescoping member may be adjusted to extend a desired distance from said body such that the speaker may be mounted to said bezel with a desired portion of the component being substantially flush with exterior member.

3. A telescoping support bracket for attaching an article to an architectural structure, the architectural structure having an interior frame and an exterior member, the telescoping mount bracket comprising:

(a) a body detachable to the interior frame;

(b) a telescoping member adjustably extendable from said body substantially to the exterior member;

(c) an article support attachable to said telescoping member configured to support the article to be attached, wherein said article support comprises a bezel; and (d) wherein extension of said telescoping member from said body allows the article to be mounted substantially flush with the exterior member despite variations and the size of the interior frame and the exterior surface member.

4. The telescoping support bracket as recited in claim 3 further comprising at least one flange attachable to said body, said flange extending outwardly from said body and having a plurality of apertures for mounting said body to the frame.

5. A telescoping speaker support bracket for attaching a speaker to an architectural structure, the architectural structure having an interior frame and an exterior member, the telescoping mount bracket comprising:

(a) a body attachable to the interior frame;

(b) a telescoping member adjustably extendable from said body substantially to the exterior member; and (c) a speaker support attachable to said telescoping member configured to support the speaker;

(d) wherein extension of said telescoping member from said body allows the speaker to be mounted substantially flush with the exterior member despite variations in the size of the interior frame and the exterior surface member;

(e) wherein said speaker support and said body are disposed on opposite sides of the exterior member such that said speaker support and said body clamp said exterior member therebetween.

6. A telescoping speaker support bracket for attaching a speaker to an architectural structure, the architectural structure having an interior frame and an exterior member, the telescoping mount bracket comprising:

(a) a body attachable to the interior frame;

(b) a telescoping member adjustably extendable from said body substantially to the exterior member; and (c) a speaker support attachable to said telescoping member configured to support the speaker; and (d) at least one first detent formed upon said body and at least one complimentary second detect formed upon said telescoping member, said first and second detents cooperating to lock said telescoping member into position relative to said body such that a desired length of said telescoping member extends therefrom;

(e) wherein extension of said telescoping member from said body allows the speaker to be mounted substantially flush with the exterior member despite variations in the size of the interior frame and the exterior surface member.

7. The telescoping speaker support bracket as recited in claim 6 wherein:

(a) said first detents comprise at least one post extending from said body; and (b) said second detents comprise a plurality of slots formed upon said telescoping member, said slots configured to receive said posts.

8. A telescoping speaker support bracket for attaching a speaker to an architectural structure, the architectural structure having an interior frame and an exterior member, the telescoping mount bracket comprising:

(a) a body attachable to the interior frame;

(b) a telescoping member adjustably extendable from said body substantially to the exterior member;

(c) a speaker support attachable to said telescoping member configured to support the speaker; and (d) at least one flange attachable to said body, said flange extending outwardly from said body and having a plurality of apertures for mounting said body to the frame;

(e) wherein extension of said telescoping member from said body allows the speaker to be mounted substantially flush with the exterior member despite variations in the size of the interior frame and the exterior surface member.

9. The telescoping speaker support bracket as recited in claim 8 wherein said at least one flange comprises two flanges attachable to diametrically opposed sides of said body.

10. A telescoping speaker support bracket for attaching a speaker to an architectural structure, the architectural structure having an interior frame and an exterior member, the telescoping mount bracket comprising:

(a) a body attachable to the interior frame;

(b) a telescoping member adjustably extendable from said body substantially to the exterior member;

(c) a speaker support attachable to said telescoping member configured to support the speaker; and (d) at least one bendable tab formed upon said telescoping member;

(e) wherein extension of said telescoping member from said body allows the speaker to be mounted substantially flush with the exterior member despite variations in the size of the interior frame and the exterior surface member.

11. The telescoping speaker support bracket as recited in claim 10 wherein said tab may be bent to engage said exterior surface to attach said telescoping member thereto.

12. A telescoping speaker support bracket for attaching a speaker to an architectural structure, the architectural structure having an interior frame and an exterior member, the telescoping mount bracket comprising:

(a) a body attachable to the interior frame;

(b) a telescoping member adjustably extendable from said body substantially to the exterior member;

(c) a speaker support attachable to said telescoping member configured to support the speaker;

(d) screw threads formed upon said body; and (e) complimentary screw threads formed upon said telescoping member such that the screw threads of said body and the screw threads of said telescoping member engage such that said telescoping member can be extended from and retracted into said body by rotation thereof;

(f) wherein extension of said telescoping member from said body allows the speaker to be mounted substantially flush with the exterior member despite variations in the size of the interior frame and the exterior surface member.

13. A telescoping support bracket for attaching an article to an architectural structure, the architectural structure having an interior frame and an exterior member, the telescoping mount bracket comprising:

(a) a body attachable to the interior frame;

(b) a telescoping member adjustably extendable from said body substantially to the exterior member;

(c) an article support attachable to said telescoping member configured to support the article to be attached; and (d) at least one first detect formed upon said body and at least one complimentary second detent formed upon said telescoping member, said first and second detents cooperating to lock said telescoping member into position relative to said body such that a desired length of said telescoping member extends therefrom;

(e) wherein extension of said telescoping member from said body allows the article to be mounted substantially flush with the exterior member despite variations in the size of the interior frame and the exterior surface member.

14. The telescoping support bracket as recited in claim 13 wherein:

(a) said first detents comprise at least one post extending from said body; and (b) said second detents comprise a plurality of slots formed upon said telescoping member, said slots configured to receive said posts.

15. A telescoping support bracket for attaching an article to an architectural structure, the architectural structure having an interior frame and an exterior member, the telescoping mount bracket comprising:

(a) a body attachable to the interior frame;

(b) a telescoping member adjustably extendable from said body substantially to the exterior member;

(c) an article support attachable to said telescoping member configured to support the article to be attached; and (d) at least one bendable tab formed upon said telescoping member;

(e) wherein extension of said telescoping member from said body allows the article to be mounted substantially flush with the exterior member despite variations in the size of the interior frame and the exterior surface member.

16. The telescoping support bracket as recited in claim 15 wherein said tab may be bent to engage said exterior surface to attach said telescoping member thereto.

17. A telescoping support bracket for attaching an article to an architectural structure, the architectural structure having an interior frame and an exterior member, the telescoping mount bracket comprising:

(a) a body attachable to the interior frame;

(b) a telescoping member adjustably extendable from said body substantially to the exterior member;

(c) an article support attachable to said telescoping member configured to support the article to be attached;

(d) screw threads formed upon said body;

(e) complimentary screw threads formed upon said telescoping member such that the screw threads of said body and the screw threads of said telescoping member engage such that said telescoping member can be extended from and retracted into said body by rotation thereof; and (f) wherein extension of said telescoping member from said body allows the article to be mounted substantially flush with the exterior member despite variations in the size of the interior frame and the exterior surface member.

18. A telescoping support bracket for attaching an article to an architectural structure, the architectural structure having an interior frame and an exterior member, the telescoping mount bracket comprising:

(a) a body attachable to the interior frame;

(b) a telescoping member adjustably extendable from said body substantially to the exterior member; and (c) an article support attachable to said telescoping member configured to support the article to be attached;

(d) wherein extension of said telescoping member from said body allows the article to be mounted substantially flush with the exterior member despite variations in the size of the interior frame and the exterior surface member;

(e) wherein said support and said body are disposed on opposite sides of the exterior member;

(f) wherein said support and said body cooperate to clamp said exterior member therebetween.

19. A telescoping support bracket for attaching an article to an architectural structure, the architectural structure having an interior frame and an exterior member, the telescoping mount bracket comprising:

(a) a body attachable to the interior frame;

(b) a telescoping member adjustably extendable from said body substantially to the exterior member;

(c) an article support attachable to said telescoping member configured to support the article to be attached; and (d) at least one flange attachable to said body, said flange extending outwardly form said body and having a plurality of apertures for mounting said body to the frame;

(e) wherein extension of said telescoping member from said body allows the article to be mounted substantially flush with the exterior member despite variations in the size of the interior frame and the exterior surface member.

20. The telescoping support bracket as recited in claim 19 wherein said at least one flange comprises two flanges attachable to diametrically opposed sides of said body.

* * * * *